US010875055B2

(12) United States Patent
Zhang et al.

(10) Patent No.: US 10,875,055 B2
(45) Date of Patent: Dec. 29, 2020

(54) MODULAR QUALITY IMPROVEMENT PROCESS AND QUALITY IMPROVEMENT SYSTEM FOR HIGH DENSITY COAL MEASURES OIL SHALE

(71) Applicants: China University of Mining and Technology, Jiangsu (CN); XUZHOU ZHIRUN MINING EQUIPMENT SCIENCE AND TECHNOLOGY CO., LTD., Jiangsu (CN)

(72) Inventors: Bo Zhang, Jiangsu (CN); Yuemin Zhao, Jiangsu (CN); Chenyang Zhou, Jiangsu (CN); Xuchen Fan, Jiangsu (CN); Chenlong Duan, Jiangsu (CN); Liang Dong, Jiangsu (CN); Jingfeng He, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 170 days.

(21) Appl. No.: 16/305,389

(22) PCT Filed: Dec. 12, 2017

(86) PCT No.: PCT/CN2017/115556
§ 371 (c)(1),
(2) Date: Nov. 28, 2018

(87) PCT Pub. No.: WO2018/145512
PCT Pub. Date: Aug. 16, 2018

(65) Prior Publication Data

US 2020/0130018 A1 Apr. 30, 2020

(30) Foreign Application Priority Data

Feb. 9, 2017 (CN) ..... 2017 1 0070575

(51) Int. Cl.
*B07B 9/00* (2006.01)

(52) U.S. Cl.
CPC ..... *B07B 9/00* (2013.01)

(58) Field of Classification Search
CPC ..... B03B 4/06; B03B 4/065; B03B 9/005; B03B 9/02; B07B 9/00; B07B 9/02; B07B 2201/04; B03C 1/30; B03C 2201/20
(Continued)

(56) References Cited

U.S. PATENT DOCUMENTS 4,130,474 A * 12/1978 Anthony ..... C10G 1/00 208/435
4,257,878 A * 3/1981 Fishback ..... C10G 1/00 208/435
(Continued)

FOREIGN PATENT DOCUMENTS

CN 202845326 4/2013
CN 104984819 10/2015
(Continued)

OTHER PUBLICATIONS

Xia et al., "Study on the Technology for Dry Separation of Oil Shale with Air Dense Medium", Coal Processing & Comprehensive Utilization, Nov. 25, 2016, pp. 66-68 and 71.
(Continued)

*Primary Examiner* — Joseph C Rodriguez
(74) *Attorney, Agent, or Firm* — JCIPRNET

(57) ABSTRACT

A modular quality improvement process and quality improvement system for high density coal measures oil shale. The process comprises: performing separation on the material with a particle size larger than 13 mm by an air dense medium fluidized bed, performing separation on the material with a particle size equal to or less than 13 mm and larger than 6 mm by an air dense medium fluidized bed, performing separation on the material with a particle size equal to or less than 6 mm and larger than 3 mm by a
(Continued)

vibrated dense medium fluidized bed, and performing separation on the material with a particle size equal to or less than 3 mm by a vibrated fluidized bed, and recovery of a medium by magnetic separation for use as a circulating medium.

10 Claims, 4 Drawing Sheets

(58) Field of Classification Search
USPC ..... 209/12.1, 20, 21, 38, 39, 40
See application file for complete search history.

(56) References Cited

U.S. PATENT DOCUMENTS 4,348,274 A * 9/1982 Guerre ..... B03B 5/34 208/424
4,388,179 A * 6/1983 Lewis ..... B03B 1/02 208/177
4,506,835 A * 3/1985 Tsai ..... B03B 1/04 209/166
4,588,478 A * 5/1986 Warzel ..... C10B 49/00 202/99
5,074,435 A * 12/1991 Suverkrop ..... B02C 21/02 177/50
5,197,398 A 3/1993 Levy et al.
5,341,935 A * 8/1994 Djerf ..... B03B 4/00 209/11
5,392,922 A * 2/1995 Chen ..... B03B 5/46 198/728
5,943,231 A * 8/1999 Thomas ..... B03B 4/02 209/489
6,786,941 B2 * 9/2004 Reeves ..... B03B 9/005 209/10
7,124,817 B1 * 10/2006 Sunde ..... C09K 8/58 166/246
7,380,669 B2 * 6/2008 Hacking, Jr. ..... B01F 3/188 209/10
7,918,343 B2 * 4/2011 Bohlig ..... B03B 9/062 209/12.1

FOREIGN PATENT DOCUMENTS

CN 105080702 11/2015
CN 105381950 3/2016
CN 106362856 2/2017
CN 106607183 5/2017

OTHER PUBLICATIONS

"International Search Report (Form PCT/ISA/210)", dated Mar. 9, 2018, with English translation thereof, pp. 1-6.

* cited by examiner

MODULAR QUALITY IMPROVEMENT PROCESS AND QUALITY IMPROVEMENT SYSTEM FOR HIGH DENSITY COAL MEASURES OIL SHALE

CROSS-REFERENCE TO RELATED APPLICATION

This application is a 371 application of an international PCT application serial no. PCT/CN2017/115556, filed on Dec. 12, 2017, which claims priority to and the benefit of China Patent Application No. 201710070575.4, filed on Feb. 9, 2017. The entirety of each of the above-mentioned patent applications is hereby incorporated by reference herein and made a part of this specification.

BACKGROUND OF THE INVENTION

Field of the Invention

The present invention relates to a quality improvement process and quality improvement system for oil shale, and in particular to a modular quality improvement process and quality improvement system for high density coal measures oil shale.

Description of Related Art

With continuous growth of energy needs and increasingly shortage of conventional energy sources, conventional energy sources represented by coal and petroleum have gradually failed to meet the demands of production and development. As an unconventional energy source, oil shale has attracted extensive attention due to its rich reserves and unique physicochemical properties. Oil shale, also known as oil forming shale, is a fine-grained sedimentary rock rich in an organic matter (kerogen), shows schistosity structure, and has oil content of 3.5% to 30%, high ash content (>40%), heat production of generally ≥4.19 kJ $kg^{-1}$, and no definitive molecular formula. The total content of the organic matter in oil shale is generally less than 35% based on the total mass, and such an organic matter is filled in a backbone of an inorganic mineral, is mainly composed of kerogen and bitumen, and is an organic high molecular weight polymer. The reserve of oil shale in U.S. is about 300 billion tons, accounting for 60% of the total resource amount in the world, and the reserve of oil shale in China is about 719.9 billion tons, ranking the second place.

In a conventional method of use of oil shale, mined oil shale is directly pyrolyzed and retorted without pretreatment. The disadvantage of the method of use is that more ash is generated during pyrolyzing and retorting, so that the oil content is reduced and a certain damage to the reactor is caused.

Currently, there are few researches on a quality improvement process for pretreatment of oil shale. For a common water-washing process, subsequent processes such as drying and dehydrating may be required, which not only are time-consuming, but also further increase treatment costs. In addition, the shortage of water resources is present. Thus, there is an urgent need for a quality improvement process for coal measures oil shale under anhydrous condition.

SUMMARY OF THE INVENTION

An objective of the present invention is to provide a modular quality improvement process and apparatus for high density coal measures oil shale with brevity and clarity in technical route and simplicity in process flow, so as to increase oil content of an oil shale concentrate, reduce environmental pollution, and improve utilization efficiency.

The objective of the present invention is achieved by a quality improvement process for oil shale, comprising the following stages: a +13 mm separation stage, a 13-6 mm separation stage, a 6-3 mm separation stage, a −3 mm separation stage, and a medium recovery and recycle stage.

The +13 mm separation stage comprises sieving a raw sample by a sieve with a mesh size of 13 mm to obtain material with a particle size larger than 13 mm and performing separation on the material by a high density air dense medium fluidized bed or a compound dry separator according to a moisture content of the material so as to achieve product requirements.

The 13-6 mm separation stage comprises sieving a material with a particle size equal to or less than 13 mm by a sieve with a mesh size of 6 mm to obtain material with a particle size equal to or less than 13 mm and larger than 6 mm and performing separation on the material by a high density air dense medium fluidized bed or a compound dry separator according to a moisture content of the material so as to achieve product requirements.

The 6-3 mm separation stage comprises sieving a material with a particle size equal to or less than 6 mm obtained from the raw sample by a sieve with a mesh size of 3 mm to obtain material with a particle size equal to or less than 6 mm and larger than 3 mm and performing separation on the material by a vibrated dense medium fluidized bed or a vibrated fluidized bed according to a moisture content of the material so as to achieve product requirements.

The −3 mm separation stage comprises sieving a material with a particle size equal to or less than 6 mm obtained from the raw sample by a sieve with a mesh size of 3 mm to obtain material with a particle size equal to or less than 3 mm and performing separation on the material by a vibrated fluidized bed so as to achieve product requirements.

The medium recycling stage comprises performing separation on a separated product from a high density air dense medium fluidized bed and a vibrated dense medium fluidized bed by a dry magnetic separator to obtain a medium carried with the product such that the medium is recovered and recycled.

Preferably, subsequent to the sieving by the sieve with a mesh size of 13 mm, if the material with a particle size larger than 13 mm has a moisture greater than 10%, the material is transported to a compound dry separator for separation through a belt and a feeder; and if the material with a particle size larger than 13 mm has a moisture less than 10%, the material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

Preferably, subsequent to the sieving of the material with a particle size equal to or less than 13 mm by the sieve with a mesh size of 6 mm, if the material with a particle size equal to or less than 13 mm and larger than 6 mm has a moisture greater than 10%, the material is transported to a compound dry separator for separation through a belt and a feeder; and if the material with a particle size equal to or less than 13 mm and larger than 6 mm has a moisture less than 10%, the material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

Preferably, subsequent to the sieving of the material with a particle size equal to or less than 6 mm by the sieve with a mesh size of 3 mm, if the material with a particle size equal to or less than 6 mm and larger than 3 mm has a moisture greater than 10%, the material is transported to a vibrated fluidized bed for separation through a belt and a feeder; and if the material with a particle size equal to or less than 6 mm and larger than 3 mm has a moisture less than 10%, the material is transported to a vibrated dense medium fluidized bed for separation through a belt and a feeder; a concentrate and a tailing are transported to a concentrate bin and a tailing bin, respectively; and the concentrate is an oil shale concentrate and the tailing is gangue.

Preferably, subsequent to the sieving of the material with a particle size equal to or less than 6 mm by the sieve with a mesh size of 3 mm, the material with a particle size equal to or less than 3 mm is transported to a vibrated fluidized bed for separation; a concentrate and a tailing are transported to a concentrate bin and a tailing bin, respectively; and the concentrate is an oil shale concentrate and the tailing is gangue.

A yield of a separated product for the high density air dense medium fluidized bed is adjusted by adjusting air flow rate, separation time, bed height, composition of medium solids, and porosity of an air distribution plate; wherein for separation of the material with a particle size larger than 13 mm, operation conditions of the high density air dense medium fluidized bed are: air flow rate of 1.5-1.95 m/s, separation time of 200-300 s, bed height of 100-300 mm, content of ferrosilicon powder with a particle size of 0.3-0.5 mm in medium solids ranging from 70-90%, and porosity of an air distribution plate ranging from 30-50%; and for separation of the material with a particle size equal to or less than 13 mm and larger than 6 mm, operation conditions of the high density air dense medium fluidized bed are: air flow rate of 1.25-1.75 m/s, separation time of 200-300 s, bed height of 80-250 mm, content of ferrosilicon powder with a particle size of 0.3-0.5 mm in medium solids ranging from 50-70%, and porosity of an air distribution plate ranging from 25-45%.

A yield of a separated product for the compound dry separator is adjusted by adjusting air flow rate, separation time, porosity of an air distribution plate, vibration intensity, and bed tilt angle; wherein for separation of the material with a particle size larger than 13 mm, operation conditions of the compound dry separator are: air flow rate of 1.05-1.55 m/s, separation time of 200-300 s, porosity of an air distribution plate ranging from 30-50%, vibration intensity of 2.3-8.4, and bed tilt angle of 2°-4°; and for separation of the material with a particle size equal to or less than 13 mm and larger than 6 mm, operation conditions of the compound dry separator are: air flow rate of 1.25-1.45 m/s, separation time of 200-300 s, porosity of an air distribution plate ranging from 30-50%, vibration intensity of 2.2-8.0, and bed tilt angle of 1°-3°.

A yield of a separated product for the vibrated dense medium fluidized bed is adjusted by adjusting air flow rate, separation time, bed height, composition of medium solids, porosity of an air distribution plate, and vibration intensity; wherein for separation of the material with a particle size equal to or less than 6 mm and larger than 3 mm, operation conditions of the vibrated dense medium fluidized bed are: air flow rate of 1.15-1.65 m/s, bed height of 80-200 mm, content of ferrosilicon powder with a particle size of 0.3-0.5 mm in medium solids ranging from 40-60%, separation time of 200-300 s, porosity of an air distribution plate ranging from 25-55%, and vibration intensity of 1.21-6.50.

A yield of a separated product for the vibrated fluidized bed is adjusted by adjusting air flow rate, separation time, bed height, porosity of an air distribution plate, and vibration intensity; wherein for separation of the material with a particle size equal to or less than 6 mm and larger than 3 mm, operation conditions of the vibrated fluidized bed are: air flow rate of 1.15-2.15 m/s, bed height of 80-200 mm, separation time of 200-300 s, porosity of an air distribution plate ranging from 25-55%, and vibration intensity of 1.21-6.54; and for separation of the material with a particle size equal to or less than 3 mm, operation conditions of the vibrated fluidized bed are: air flow rate of 1.15-1.85 m/s, bed height of 80-200 mm, separation time of 200-300 s, porosity of an air distribution plate ranging from 25-55%, and vibration intensity of 1.21-5.82.

The modular quality improvement system for high density coal measures oil shale comprises an air tank, a filter, a roots blower, a pressure tank, a pressure gauge, a rotameter, a feeder, a sieving device, a belt, a dry magnetic separator, a high density dense medium fluidized bed, an air dense medium fluidized bed, a compound dry separator, a vibrated dense medium fluidized bed, a vibrated fluidized bed, and a dry magnetic separator; wherein the air tank is connected to an input end of the roots blower through the filter, and an output end of the roots blower is connected to the pressure tank, the rotameter, the sieving device, and the feeder sequentially; the pressure gauge is connected to the pressure tank; coal measures oil shale is graded in accordance with particle size thereof through the sieving device, and is transported to the belt through the feeder, an output end of the belt is connected to four separation channels, respectively: the high density dense medium fluidized bed or compound dry separator, the air dense medium fluidized bed or compound dry separator, the vibrated dense medium fluidized bed or vibrated fluidized bed, and the vibrated fluidized bed, and the dry magnetic separator is connected downstream of the high density dense medium fluidized bed or compound dry separator, the air dense medium fluidized bed or compound dry separator, the vibrated dense medium fluidized bed or vibrated fluidized bed, respectively; the coal measures oil shale is transported to different separators for separation according to its size grade; according to moisture contents of the coal measures oil shale of each size grade, the material with a particle size larger than 13 mm is transported to the high density air dense medium fluidized bed or compound dry separator for separation, the material with a particle size equal to or less than 13 mm and larger than 6 mm is transported to the air dense medium fluidized bed or compound dry separator for separation, the material with a particle size equal to or less than 6 mm and larger than 3 mm is transported to the vibrated dense medium fluidized bed or vibrated fluidized bed for separation, and a material with a particle size equal to or less than 3 mm is transported to the vibrated fluidized bed for separation, and a medium is recovered by the dry magnetic separator during the separation.

Advantageous Effect: With the above solution, air passing through an air filter is sent to a roots blower and to a pressure tank, where the pressure of the pressure tank is adjusted by a pressure gauge, and the flow rate is adjusted by a rotameter. Coal measures oil shale is graded in accordance with particle size thereof through a sieving device, and is transported to a belt through a feeder and to different separators according to the particle sizes. According to moisture differences of size fractions, the material with a particle size larger than 13 mm is transported to a high density air dense medium fluidized bed or compound dry separator for separation, the material with a particle size equal to or less than 13 mm and larger than 6 mm is transported to an air dense medium fluidized bed or compound dry separator for separation, the material with a particle size equal to or less than 6 mm and larger than 3 mm is transported to a vibrated dense medium fluidized bed or vibrated fluidized bed for separation, and a material with a particle size equal to or less than 3 mm is transported to a vibrated fluidized bed for separation. A medium is recovered by a dry magnetic separator during the separation. Unlike direct processing without separation in the prior art, oil shale is subjected to preconcentration, thus reducing processing costs. In addition, the use of a dry process in the processing avoids dissociation of oil shale in water and loss of useful materials, and reduction of the use of water resources avoids subsequent treatments and secondary pollution to the environment, thus improving utilization efficiency of oil shale.

Advantages: due to brevity and clarity in technical route and simplicity in process flow, the process of the present invention achieves efficient separation of coal measures oil shale, and is of great significance for development and utilization of coal measures oil shale resources in China.

DETAILED DESCRIPTION OF THE INVENTION

Figure 1:
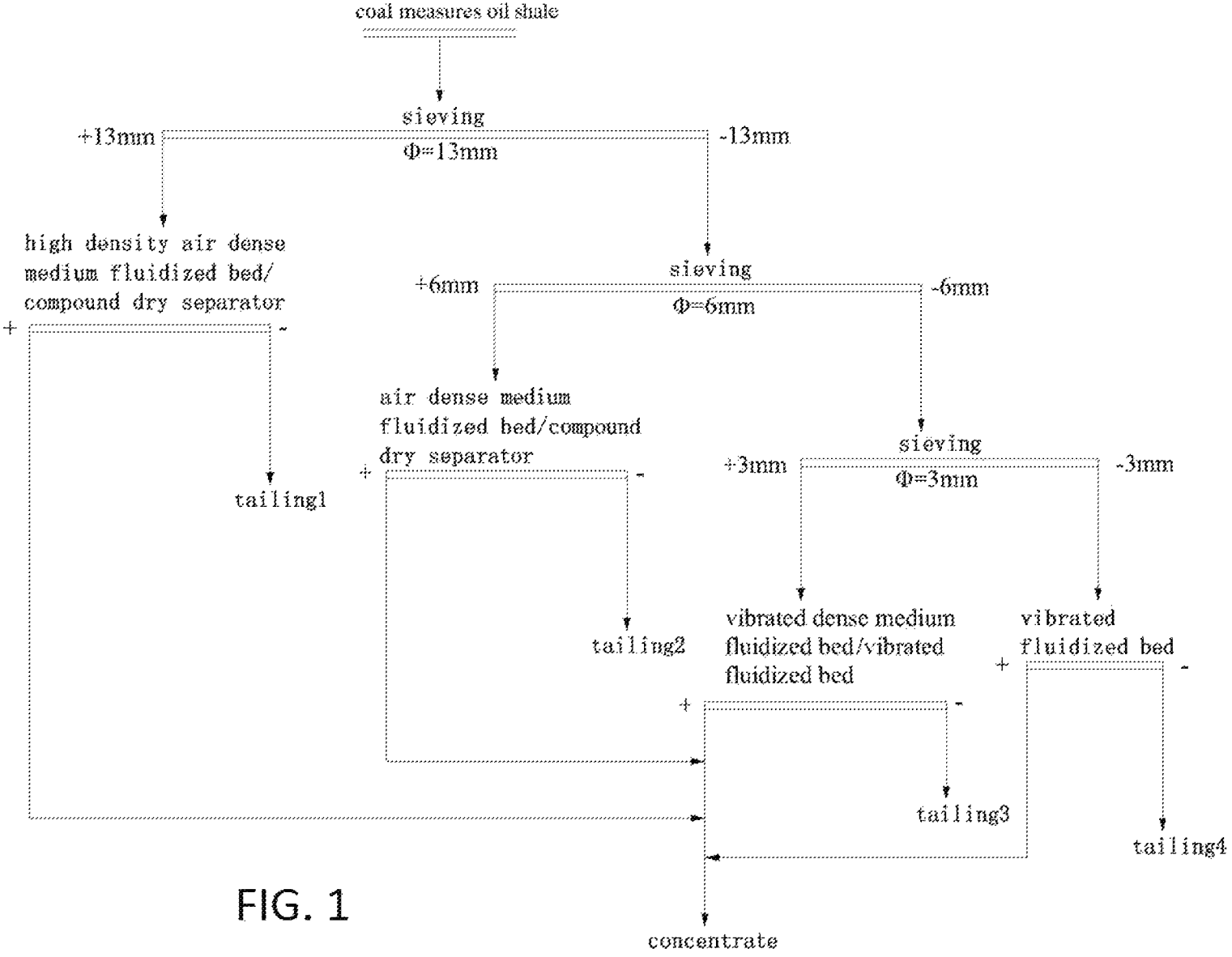
FIG. 1 is a flow diagram of a process according to the present invention.

A quality improvement process for oil shale comprises the following stages: a +13 mm separation stage, a 13-6 mm separation stage, a 6-3 mm separation stage, a −3 mm separation stage, and a medium recovery and recycle stage.

The +13 mm separation stage comprises sieving a raw sample by a sieve with a mesh size of 13 mm to obtain material with a particle size larger than 13 mm and performing separation on the material by a high density air dense medium fluidized bed or a compound dry separator according to a moisture content of the material so as to achieve product requirements.

The 13-6 mm separation stage comprises sieving a material with a particle size equal to or less than 13 mm by a sieve with a mesh size of 6 mm to obtain material with a particle size equal to or less than 13 mm and larger than 6 mm and performing separation on the material by a high density air dense medium fluidized bed or a compound dry separator according to a moisture content of the material so as to achieve product requirements.

The 6-3 mm separation stage comprises sieving a material with a particle size equal to or less than 6 mm obtained from the raw sample by a sieve with a mesh size of 3 mm to obtain material with a particle size equal to or less than 6 mm and larger than 3 mm and performing separation on the material by a vibrated dense medium fluidized bed or a vibrated fluidized bed according to a moisture content of the material so as to achieve product requirements.

The −3 mm separation stage comprises sieving a material with a particle size equal to or less than 6 mm obtained from the raw sample by a sieve with a mesh size of 3 mm to obtain material with a particle size equal to or less than 3 mm and performing separation on the material by a vibrated fluidized bed so as to achieve product requirements.

The medium recovery and recycle stage comprises performing separation on a separated product from a high density air dense medium fluidized bed and a vibrated dense medium fluidized bed by a dry magnetic separator to obtain a medium carried with the product such that the medium is recovered and recycled.

Preferably, subsequent to the sieving by the sieve with a mesh size of 13 mm, if the material with a particle size larger than 13 mm has a moisture greater than 10%, the material is transported to a compound dry separator for separation through a belt and a feeder; and if the material with a particle size larger than 13 mm has a moisture less than 10%, the material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

Preferably, subsequent to the sieving of the material with a particle size equal to or less than 13 mm by the sieve with a mesh size of 6 mm, if the material with a particle size equal to or less than 13 mm and larger than 6 mm has a moisture greater than 10%, the material is transported to a compound dry separator for separation through a belt and a feeder; and if the material with a particle size equal to or less than 13 mm and larger than 6 mm has a moisture less than 10%, the material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

Preferably, subsequent to the sieving of the material with a particle size equal to or less than 6 mm by the sieve with a mesh size of 3 mm, if the material with a particle size equal to or less than 6 mm and larger than 3 mm has a moisture greater than 10%, the material is transported to a vibrated fluidized bed for separation through a belt and a feeder; and if the material with a particle size equal to or less than 6 mm and larger than 3 mm has a moisture less than 10%, the material is transported to a vibrated dense medium fluidized bed for separation through a belt and a feeder; a concentrate and a tailing are transported to a concentrate bin and a tailing bin, respectively; and the concentrate is an oil shale concentrate and the tailing is gangue.

Preferably, subsequent to the sieving of the material with a particle size equal to or less than 6 mm by the sieve with a mesh size of 3 mm, the material with a particle size equal to or less than 3 mm is transported to a vibrated fluidized bed for separation; a concentrate and a tailing are transported to a concentrate bin and a tailing bin, respectively; and the concentrate is an oil shale concentrate and the tailing is gangue.

A yield of a separated product for the high density air dense medium fluidized bed is adjusted by adjusting air flow rate, separation time, bed height, composition of medium solids, and porosity of an air distribution plate; wherein for separation of the material with a particle size larger than 13 mm, operation conditions of the high density air dense medium fluidized bed are: air flow rate of 1.5-1.95 m/s, separation time of 200-300 s, bed height of 100-300 mm, content of ferrosilicon powder with a particle size of 0.3-0.5 mm in medium solids ranging from 70-90%, and porosity of an air distribution plate ranging from 30-50%; and for separation of the material with a particle size equal to or less than 13 mm and larger than 6 mm, operation conditions of the high density air dense medium fluidized bed are: air flow rate of 1.25-1.75 m/s, separation time of 200-300 s, bed height of 80-250 mm, content of ferrosilicon powder with a particle size of 0.3-0.5 mm in medium solids ranging from 50-70%, and porosity of an air distribution plate ranging from 25-45%.

A yield of a separated product for the compound dry separator is adjusted by adjusting air flow rate, separation time, porosity of an air distribution plate, vibration intensity, and bed tilt angle; wherein for separation of the material with a particle size larger than 13 mm, operation conditions of the compound dry separator are: air flow rate of 1.05-1.55 m/s, separation time of 200-300 s, porosity of an air distribution plate ranging from 30-50%, vibration intensity of 2.3-8.4, and bed tilt angle of 2°-4°; and for separation of the material with a particle size equal to or less than 13 mm and larger than 6 mm, operation conditions of the compound dry separator are: air flow rate of 1.25-1.45 m/s, separation time of 200-300 s, porosity of an air distribution plate ranging from 30-50%, vibration intensity of 2.2-8.0, and bed tilt angle of 1°-3°.

A yield of a separated product for the vibrated dense medium fluidized bed is adjusted by adjusting air flow rate, separation time, bed height, composition of medium solids, porosity of an air distribution plate, and vibration intensity; wherein for separation of the material with a particle size equal to or less than 6 mm and larger than 3 mm, operation conditions of the vibrated dense medium fluidized bed are: air flow rate of 1.15-1.65 m/s, bed height of 80-200 mm, content of ferrosilicon powder with a particle size of 0.3-0.5 mm in medium solids ranging from 40-60%, separation time of 200-300 s, porosity of an air distribution plate ranging from 25-55%, and vibration intensity of 1.21-6.50.

A yield of a separated product for the vibrated fluidized bed is adjusted by adjusting air flow rate, separation time, bed height, porosity of an air distribution plate, and vibration intensity; wherein for separation of the material with a particle size equal to or less than 6 mm and larger than 3 mm, operation conditions of the vibrated fluidized bed are: air flow rate of 1.15-2.15 m/s, bed height of 80-200 mm, separation time of 200-300 s, porosity of an air distribution plate ranging from 25-55%, and vibration intensity of 1.21-6.54; and for separation of the material with a particle size equal to or less than 3 mm, operation conditions of the vibrated fluidized bed are: air flow rate of 1.15-1.85 m/s, bed height of 80-200 mm, separation time of 200-300 s, porosity of an air distribution plate ranging from 25-55%, and vibration intensity of 1.21-5.82.

The modular quality improvement system for high density coal measures oil shale comprises an air tank, a filter, a roots blower, a pressure tank, a pressure gauge, a rotameter, a feeder, a sieving device, a belt, a dry magnetic separator, a high density dense medium fluidized bed, an air dense medium fluidized bed, a compound dry separator, a vibrated dense medium fluidized bed, a vibrated fluidized bed, and a dry magnetic separator; wherein the air tank is connected to an input end of the roots blower through the filter, and an output end of the roots blower is connected to the pressure tank, the rotameter, the sieving device, and the feeder sequentially; the pressure gauge is connected to the pressure tank; coal measures oil shale is graded in accordance with particle size thereof through the sieving device, and is transported to the belt through the feeder, an output end of the belt is connected to four separation channels, respectively: the high density dense medium fluidized bed or compound dry separator, the air dense medium fluidized bed or compound dry separator, the vibrated dense medium fluidized bed or vibrated fluidized bed, and the vibrated fluidized bed, and the dry magnetic separator is connected downstream of the high density dense medium fluidized bed or compound dry separator, the air dense medium fluidized bed or compound dry separator, the vibrated dense medium fluidized bed or vibrated fluidized bed, respectively; the coal measures oil shale is transported to different separators for separation according to its size grade; according to moisture contents of the coal measures oil shale of each size grade, the material with a particle size larger than 13 mm is transported to the high density air dense medium fluidized bed or compound dry separator for separation, the material with a particle size equal to or less than 13 mm and larger than 6 mm is transported to the air dense medium fluidized bed or compound dry separator for separation, the material with a particle size equal to or less than 6 mm and larger than 3 mm is transported to the vibrated dense medium fluidized bed or vibrated fluidized bed for separation, and a material with a particle size equal to or less than 3 mm is transported to the vibrated fluidized bed for separation, and a medium is recovered by the dry magnetic separator during the separation.

The present invention is further described below with reference to the accompanying drawings.

Figure 2:
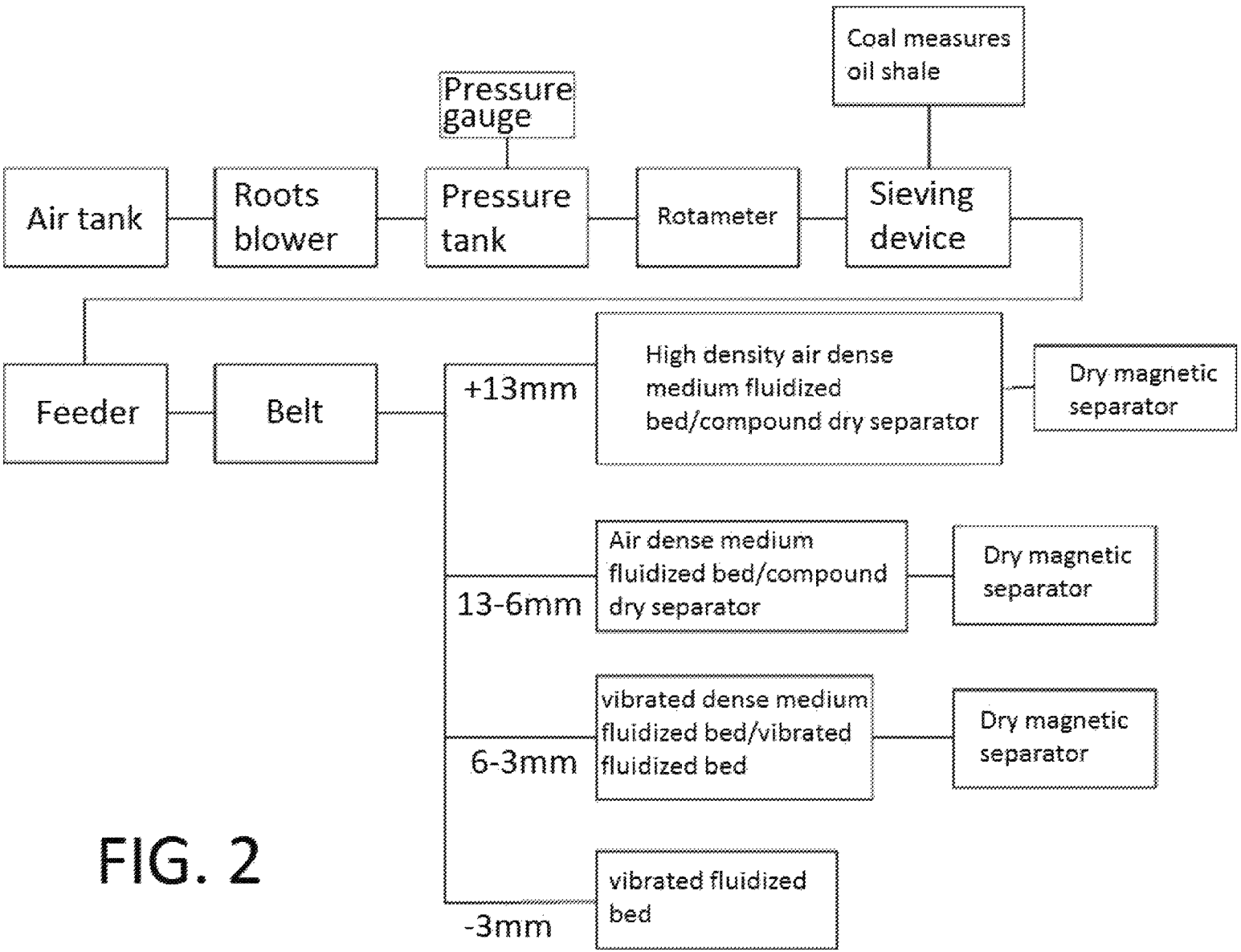
FIG. 2 is a diagram showing a quality improvement system according to the present invention.

Example 1: when oil shale has a moisture greater than 10%, a process without addition of a medium is used in updating, as shown in FIG. 2.

The process mainly comprises the following stages: a +13 mm separation stage, a 13-6 mm separation stage, a 6-3 mm separation stage, a −3 mm separation stage, and a medium recovery and recycle stage.

The +13 mm separation stage comprises sieving a raw sample by a sieve with a mesh size of 13 mm to obtain material with a particle size larger than 13 mm and performing separation on the material by a compound dry separator so as to achieve product requirements.

The 13-6 mm separation stage comprises sieving a material with a particle size equal to or less than 13 mm by a sieve with a mesh size of 6 mm to obtain material with a particle size equal to or less than 13 mm and larger than 6 mm and performing separation on the material by a compound dry separator so as to achieve product requirements.

The 6-3 mm separation stage comprises sieving a material with a particle size equal to or less than 6 mm obtained from the raw sample by a sieve with a mesh size of 3 mm to obtain material with a particle size equal to or less than 6 mm and larger than 3 mm and performing separation on the material by a vibrated fluidized bed so as to achieve product requirements.

The −3 mm separation stage comprises sieving a material with a particle size equal to or less than 6 mm obtained from the raw sample by a sieve with a mesh size of 3 mm to obtain material with a particle size equal to or less than 3 mm and performing separation on the material by a vibrated fluidized bed so as to achieve product requirements.

Subsequent to the sieving by the sieve with a mesh size of 13 mm, a material is transported to a compound dry separator for separation through a belt and a feeder; a concentrate and a tailing are transported to a concentrate bin and a tailing bin, respectively; and the concentrate is an oil shale concentrate and the tailing is gangue.

Subsequent to the sieving of the material with a particle size equal to or less than 13 mm by the sieve with a mesh size of 6 mm, a material is transported to a compound dry separator for separation through a belt and a feeder; a concentrate and a tailing are transported to a concentrate bin and a tailing bin, respectively; and the concentrate is an oil shale concentrate and the tailing is gangue.

Subsequent to the sieving of the material with a particle size equal to or less than 6 mm by the sieve with a mesh size of 3 mm, a material is transported to a vibrated dense medium fluidized bed for separation through a belt and a feeder; a concentrate and a tailing are transported to a concentrate bin and a tailing bin, respectively; and the concentrate is an oil shale concentrate and the tailing is gangue.

Subsequent to the sieving of the material with a particle size equal to or less than 6 mm by the sieve with a mesh size of 3 mm, the material with a particle size equal to or less than 3 mm is transported to a vibrated fluidized bed for separation; a concentrate and a tailing are transported to a concentrate bin and a tailing bin, respectively; and the concentrate is an oil shale concentrate and the tailing is gangue.

A yield of a separated product for the compound dry separator is adjusted by adjusting air flow rate, separation time, porosity of an air distribution plate, vibration intensity, and bed tilt angle; wherein for separation of the material with a particle size larger than 13 mm, operation conditions of the compound dry separator are: air flow rate of 1.05-1.55 m/s, separation time of 200-300 s, porosity of an air distribution plate ranging from 30-50%, vibration intensity of 2.3-8.4, and bed tilt angle of 2°-4°; and for separation of the material with a particle size equal to or less than 13 mm and larger than 6 mm, operation conditions of the compound dry separator are: air flow rate of 1.25-1.45 m/s, separation time of 200-300 s, porosity of an air distribution plate ranging from 30-50%, vibration intensity of 2.2-8.0, and bed tilt angle of 1°-3°.

A yield of a separated product for the vibrated fluidized bed is adjusted by adjusting air flow rate, separation time, bed height, porosity of an air distribution plate, and vibration intensity; wherein for separation of the material with a particle size equal to or less than 6 mm and larger than 3 mm, operation conditions of the vibrated fluidized bed are: air flow rate of 1.15-2.15 m/s, bed height of 80-200 mm, separation time of 200-300 s, porosity of an air distribution plate ranging from 25-55%, and vibration intensity of 1.21-6.54; and for separation of the material with a particle size equal to or less than 3 mm, operation conditions of the vibrated fluidized bed are: air flow rate of 1.15-1.85 m/s, bed height of 80-200 mm, separation time of 200-300 s, porosity of an air distribution plate ranging from 25-55%, and vibration intensity of 1.21-5.82.

Figure 3:
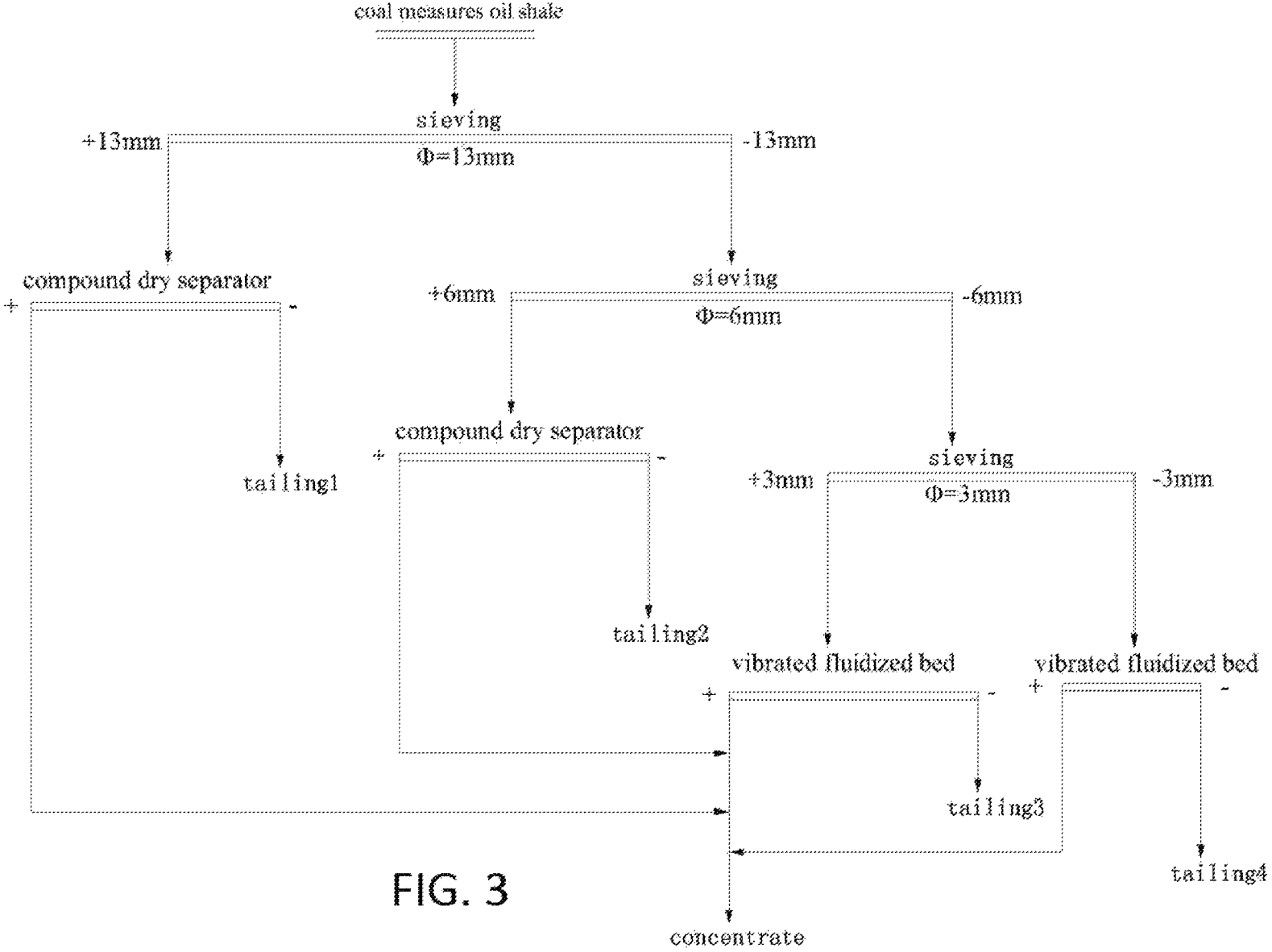
FIG. 3 is a process flow diagram of an implementation of the process where oil shale has a moisture less than 10% according to the present invention.
Figure 4:
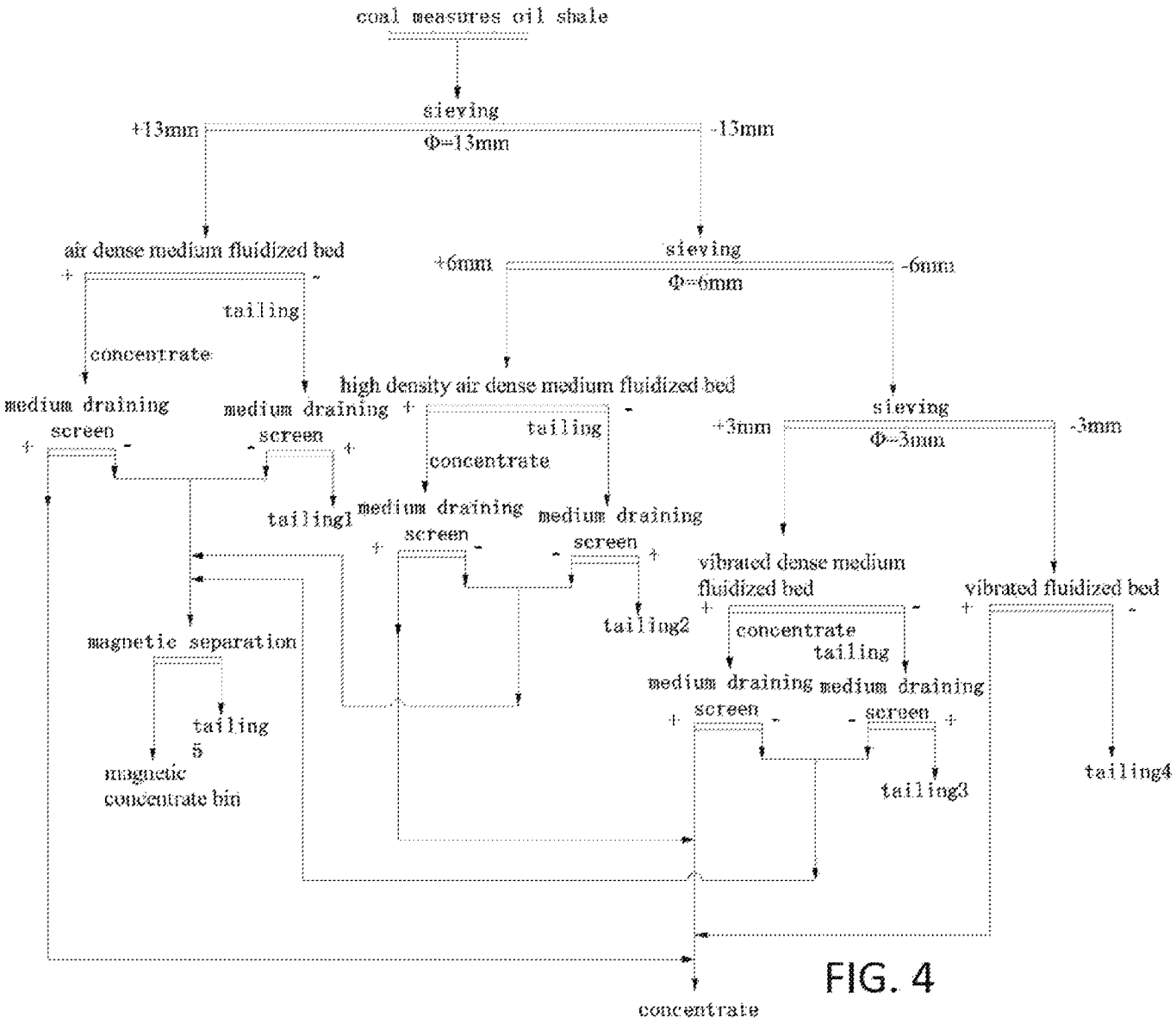
FIG. 4 is a process flow diagram of an implementation of the process where oil shale has a moisture greater than 10% according to the present invention.

Example 2: when oil shale has a moisture less than 10%, a process with addition of a medium is used in updating, as shown in FIG. 3.

The process mainly comprises the following stages: a +13 mm separation stage, a 13-6 mm separation stage, a 6-3 mm separation stage, a −3 mm separation stage, and a medium recovery and recycle stage.

The +13 mm separation stage comprises sieving a raw sample by a sieve with a mesh size of 13 mm to obtain material with a particle size larger than 13 mm and performing separation on the material by a high density air dense medium fluidized bed so as to achieve product requirements.

The 13-6 mm separation stage comprises sieving a material with a particle size equal to or less than 13 mm by a sieve with a mesh size of 6 mm to obtain material with a particle size equal to or less than 13 mm and larger than 6 mm and performing separation on the material by a high density air dense medium fluidized bed so as to achieve product requirements.

The 6-3 mm separation stage comprises sieving a material with a particle size equal to or less than 6 mm obtained from the raw sample by a sieve with a mesh size of 3 mm to obtain material with a particle size equal to or less than 6 mm and larger than 3 mm and performing separation on the material by a vibrated dense medium fluidized bed so as to achieve product requirements.

The −3 mm separation stage comprises sieving a material with a particle size equal to or less than 6 mm obtained from the raw sample by a sieve with a mesh size of 3 mm to obtain material with a particle size equal to or less than 3 mm and performing separation on the material by a vibrated fluidized bed so as to achieve product requirements.

The medium recovery and recycle stage comprises a separation, recovery and recycle of a medium carried with the product from a high density air dense medium fluidized bed and a vibrated dense medium fluidized bed.

Subsequent to the sieving by the sieve with a mesh size of 13 mm, a material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

Subsequent to the sieving of the material with a particle size equal to or less than 13 mm by the sieve with a mesh size of 6 mm, a material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

Subsequent to the sieving of the material with a particle size equal to or less than 6 mm by the sieve with a mesh size of 3 mm, a material is transported to a vibrated dense medium fluidized bed for separation through a belt and a feeder; a concentrate and a tailing are transported to a concentrate bin and a tailing bin, respectively; and the concentrate is an oil shale concentrate and the tailing is gangue.

Subsequent to the sieving of the material with a particle size equal to or less than 6 mm by the sieve with a mesh size of 3 mm, the material with a particle size equal to or less than 3 mm is transported to a vibrated fluidized bed for separation; a concentrate and a tailing are transported to a concentrate bin and a tailing bin, respectively; and the concentrate is an oil shale concentrate and the tailing is gangue.

A yield of a separated product for the high density air dense medium fluidized bed is adjusted by adjusting air flow rate, separation time, bed height, composition of medium solids, and porosity of an air distribution plate; wherein for separation of the material with a particle size larger than 13 mm, operation conditions of the high density air dense medium fluidized bed are: air flow rate of 1.5-1.95 m/s, separation time of 200-300 s, bed height of 100-300 mm, content of ferrosilicon powder with a particle size of 0.3-0.5 mm in medium solids ranging from 70-90%, and porosity of an air distribution plate ranging from 30-50%; and for separation of the material with a particle size equal to or less than 13 mm and larger than 6 mm, operation conditions of the high density air dense medium fluidized bed are: air flow rate of 1.25-1.75 m/s, separation time of 200-300 s, bed height of 80-250 mm, content of ferrosilicon powder with a particle size of 0.3-0.5 mm in medium solids ranging from 50-70%, and porosity of an air distribution plate ranging from 25-45%.

A yield of a separated product for the vibrated dense medium fluidized bed is adjusted by adjusting air flow rate, separation time, bed height, composition of medium solids, porosity of an air distribution plate, and vibration intensity; wherein for separation of the material with a particle size equal to or less than 6 mm and larger than 3 mm, operation conditions of the vibrated dense medium fluidized bed are: air flow rate of 1.15-1.65 m/s, bed height of 80-200 mm, content of ferrosilicon powder with a particle size of 0.3-0.5 mm in medium solids ranging from 40-60%, separation time of 200-300 s, porosity of an air distribution plate ranging from 25-55%, and vibration intensity of 1.21-6.50.

A yield of a separated product for the vibrated fluidized bed is adjusted by adjusting air flow rate, separation time, bed height, porosity of an air distribution plate, and vibration intensity; wherein for separation of the material with a particle size equal to or less than 3 mm, operation conditions of the vibrated fluidized bed are: air flow rate of 1.15-1.85 m/s, bed height of 80-200 mm, separation time of 200-300 s, porosity of an air distribution plate ranging from 25-55%, and vibration intensity of 1.21-5.82.

The medium recovery and recycle stage is used to collect a medium carried with a separated product from a high density air dense medium fluidized bed and a vibrated dense medium fluidized bed and recycle the medium via separation by a dry magnetic separator.

The foregoing is only embodiments of the present invention and further improvements and modifications may be made by those skilled in the art without departing from the scope of the present invention. Such improvements and modifications are all intended to fall within the scope of the present invention.

What is claimed is:

1. A modular quality improvement process for oil shale in high density coal measures, wherein a dry quality improvement process, which comprises a +13 mm separation stage, a 13-6 mm separation stage, a 6-3 mm separation stage, a -3 mm separation stage, and a medium recovery and recycle stage, wherein:

the +13 mm separation stage comprises sieving a raw sample by a sieve with a mesh size of 13 mm to obtain material with a particle size larger than 13 mm and performing separation on the material by a high density air dense medium fluidized bed or a compound dry separator according to a moisture content of the material so as to achieve product requirements;

the 13-6 mm separation stage comprises sieving a material with a particle size equal to or less than 13 mm by a sieve with a mesh size of 6 mm to obtain material with a particle size equal to or less than 13 mm and larger than 6 mm and performing separation on the material by a high density air dense medium fluidized bed or a compound dry separator according to a moisture content of the material so as to achieve product requirements;

the 6-3 mm separation stage comprises sieving a material with a particle size equal to or less than 6 mm obtained from the raw sample by a sieve with a mesh size of 3 mm to obtain material with a particle size equal to or less than 6 mm and larger than 3 mm and performing separation on the material by a vibrated dense medium fluidized bed or a vibrated fluidized bed according to a moisture content of the material so as to achieve product requirements;

the −3 mm separation stage comprises sieving a material with a particle size equal to or less than 6 mm obtained from the raw sample by a sieve with a mesh size of 3 mm to obtain material with a particle size equal to or less than 3 mm and performing separation on the material by a vibrated fluidized bed so as to achieve product requirements; and the medium recovery and recycle stage comprises performing separation on a separated product from a high density air dense medium fluidized bed and a vibrated dense medium fluidized bed by a dry magnetic separator to obtain a medium carried with the product such that the medium is recovered and recycled.

2. The modular quality improvement process for the oil shale in the high density coal measures according to claim 1, wherein subsequent to the sieving of oil shale by the sieve with a mesh size of 13 mm, if the material with a particle size larger than 13 mm has a moisture greater than 10%, the material is transported to the compound dry separator for separation through a belt and a feeder; and if the material with a particle size larger than 13 mm has a moisture less than 10%, the material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

3. The modular quality improvement process for the oil shale in the high density coal measures according to claim 1, wherein subsequent to the sieving of the material with a particle size equal to or less than 13 mm by the sieve with a mesh size of 6 mm, if the material with a particle size equal to or less than 13 mm and larger than 6 mm has a moisture greater than 10%, the material is transported to a compound dry separator for separation through a belt and a feeder; and if the material with a particle size equal to or less than 13 mm and larger than 6 mm has a moisture less than 10%, the material is transported to a high density air dense medium fluidized bed for separation through a belt and a feeder; a concentrate and a tailing are transported to a concentrate bin and a tailing bin, respectively; and the concentrate is an oil shale concentrate and the tailing is gangue.

4. The modular quality improvement process for the oil shale in the high density coal measures according to claim 1, wherein subsequent to the sieving of the material with a particle size equal to or less than 6 mm by the sieve with a mesh size of 3 mm, if the material with a particle size equal to or less than 6mm and larger than 3 mm has a moisture greater than 10%, the material is transported to a vibrated dense medium fluidized bed for separation through a belt and a feeder; and if the material with a particle size equal to or less than 6 mm and larger than 3 mm has a moisture less than 10%, the material is transported to a vibrated fluidized bed for separation through a belt and a feeder; a concentrate and a tailing are transported to a concentrate bin and a tailing bin, respectively; and the concentrate is an oil shale concentrate and the tailing is gangue.

5. The modular quality improvement process for the oil shale in the high density coal measures according to claim 1, wherein subsequent to the sieving of the material with a particle size equal to or less than 6 mm by the sieve with a mesh size of 3 mm, the material with a particle size equal to or less than 3 mm is transported to a vibrated fluidized bed for separation; a concentrate and a tailing are transported to a concentrate bin and a tailing bin, respectively; and the concentrate is an oil shale concentrate and the tailing is gangue.

6. The modular quality improvement process for the oil shale in the high density coal measures according to claim 1, wherein a yield of a separated product for the high density air dense medium fluidized bed is adjusted by adjusting air flow rate, separation time, bed height, composition of medium solids, and porosity of an air distribution plate; wherein for separation of the material with a particle size larger than 13 mm, operation conditions of the high density air dense medium fluidized bed are: air flow rate of 1.5-1.95 m/s, separation time of 200-300s, bed height of 100-300 mm, content of ferrosilicon powder with a particle size of 0.3-0.5 mm in medium solids ranging from 70-90%, and porosity of an air distribution plate ranging from 30-50%; and for separation of the material with a particle size equal to or less than 13 mm and larger than 6 mm, operation conditions of the high density air dense medium fluidized bed are: air flow rate of 1.25-1.75 m/s, separation time of 200-300s, bed height of 80-250 mm, content of ferrosilicon powder with a particle size of 0.3-0.5 mm in medium solids ranging from 50-70%, and porosity of an air distribution plate ranging from 25-45%.

7. The modular quality improvement process for the oil shale in the high density coal measures according to claim 1, wherein a yield of a separated product for the compound dry separator is adjusted by adjusting air flow rate, separation time, porosity of an air distribution plate, vibration intensity, and bed tilt angle; wherein for separation of the material with a particle size larger than 13 mm, operation conditions of the compound dry separator are: air flow rate of 1.05-1.55 m/s, separation time of 200-300s, porosity of an air distribution plate ranging from 30-50%, vibration intensity of 2.3-8.4, and bed tilt angle of 2° -4° ; and for separation of the material with a particle size equal to or less than 13 mm and larger than 6 mm, operation conditions of the compound dry separator are: air flow rate of 1.25-1.45 m/s, separation time of 200-300s, porosity of an air distribution plate ranging from 30-50%, vibration intensity of 2.2-8.0, and bed tilt angle of 1° -3°.

8. The modular quality improvement process for the oil shale in the high density coal measures according to claim 1, wherein a yield of a separated product for the vibrated dense medium fluidized bed is adjusted by adjusting air flow rate, separation time, bed height, composition of medium solids, porosity of an air distribution plate, and vibration intensity; wherein for separation of the material with a particle size equal to or less than 6 mm and larger than 3 mm, operation conditions of the vibrated dense medium fluidized bed are: air flow rate of 1.15-1.65 m/s, bed height of 80-200 mm, content of ferrosilicon powder with a particle size of 0.3-0.5 mm in medium solids ranging from 40-60%, separation time of 200-300s, porosity of an air distribution plate ranging from 25-55%, and vibration intensity of 1.21-6.50.

9. The modular quality improvement process for the oil shale in the high density coal measures according to claim 1, wherein a yield of a separated product for the vibrated fluidized bed is adjusted by adjusting air flow rate, separation time, bed height, porosity of an air distribution plate, and vibration intensity; wherein for separation of the material with a particle size equal to or less than 6 mm and larger than 3 mm, operation conditions of the vibrated fluidized bed are: air flow rate of 1.15-2.15 m/s, bed height of 80-200 mm, separation time of 200-300s, porosity of an air distribution plate ranging from 25-55%, and vibration intensity of 1.21-6.54; and for separation of the material with a particle size equal to or less than 3 mm, operation conditions of the vibrated fluidized bed are: air flow rate of 1.15-1.85 m/s, bed height of 80-200mm, separation time of 200-300s, porosity of an air distribution plate ranging from 25-55%, and vibration intensity of 1.21-5.82.

10. A modular quality improvement system for used with the modular quality improvement process for oil shale in high density coal measures according to claim 1, wherein the modular quality improvement system for the oil shale in the high density coal measures comprises an air tank, a filter, a roots blower, a pressure tank, a pressure gauge, a rotameter, a feeder, a sieving device, a belt, a dry magnetic separator, a high density dense medium fluidized bed, an air dense medium fluidized bed, a compound dry separator, a vibrated dense medium fluidized bed, a vibrated fluidized bed, and a dry magnetic separator; wherein the air tank is connected to an input end of the roots blower through the filter, and an output end of the roots blower is connected to the pressure tank, the rotameter, the sieving device, and the feeder sequentially; the pressure gauge is connected to the pressure tank; the oil shale in the coal measures is graded in accordance with particle size thereof through the sieving device, and is transported to the belt through the feeder, an output end of the belt is connected to four separation channels, respectively: the high density dense medium fluidized bed or compound dry separator, the air dense medium fluidized bed or compound dry separator, the vibrated dense medium fluidized bed or vibrated fluidized bed, and the vibrated fluidized bed, and the dry magnetic separator is connected downstream of the high density dense medium fluidized bed or compound dry separator, the air dense medium fluidized bed or compound dry separator, the vibrated dense medium fluidized bed or vibrated fluidized bed, respectively; according to moisture contents of the oil shale in the coal measures of each size grade, material with a particle size larger than 13 mm is transported to the high density air dense medium fluidized bed or compound dry separator for separation, material with a particle size equal to or less than 13 mm and larger than 6 mm is transported to the air dense medium fluidized bed or compound dry separator for separation, material with a particle size equal to or less than 6 mm and larger than 3 mm is transported to the vibrated dense medium fluidized bed or vibrated fluidized bed for separation, and material with a particle size equal to or less than 3 mm is transported to the vibrated fluidized bed for separation, and a medium is recovered by the dry magnetic separator during the separation.

* * * * *